US005503048A

United States Patent [19]

Moon

[11] Patent Number: 5,503,048

[45] Date of Patent: Apr. 2, 1996

[54] QUICK RELEASE MECHANISM FOR TOOLS SUCH AS SOCKET WRENCHES

[75] Inventor: C. Robert Moon, Joliet, Ill.

[73] Assignee: Link Industries, Inc., Chicago, Ill.

[21] Appl. No.: 309,085

[22] Filed: Sep. 20, 1994

[51] Int. Cl.[6] ..... B25B 13/00

[52] U.S. Cl. ..... 81/177.85; 81/177.2; 403/20

[58] Field of Search ..... 81/177.85, 177.2, 81/177.1; 403/20, 322, 325, 328, 379; 285/385

[56] References Cited

U.S. PATENT DOCUMENTS

| | | | |
|---|---|---|---|
| 1,569,117 | 1/1926 | Carpenter . | |
| 1,660,989 | 2/1928 | Carpenter . | |
| 1,775,402 | 9/1930 | Mandl . | |
| 1,864,466 | 6/1932 | Peterson . | |
| 2,072,463 | 3/1937 | Mims | 81/125 |
| 2,108,866 | 2/1938 | Mandl | 287/119 |
| 2,290,215 | 7/1942 | Stenberg | 287/53 |
| 2,721,090 | 10/1955 | Kaman | 287/119 |
| 2,736,562 | 2/1956 | Blackburn | 279/76 |
| 3,011,794 | 12/1961 | Vaughn | 279/76 |
| 3,018,866 | 1/1962 | Elliott et al. | 192/150 |
| 3,069,945 | 12/1962 | Shandel | 81/53 |
| 3,094,344 | 6/1963 | Varga | 287/52.08 |
| 3,156,479 | 11/1964 | Drazick | 279/76 |
| 3,167,338 | 1/1965 | Troike | 287/119 |
| 3,208,318 | 9/1965 | Roberts | 81/177 |
| 3,515,399 | 6/1968 | Wordsworth | 279/93 |
| 3,613,221 | 3/1969 | Pronk | 29/526 |
| 3,777,596 | 12/1973 | Smyers, Jr. et al. | 81/177 G |
| 3,822,074 | 7/1974 | Welcker | 285/305 |
| 3,890,051 | 6/1975 | Biek | 403/20 |
| 4,367,663 | 1/1983 | Merics | 81/177 A |
| 4,399,722 | 8/1983 | Sardo, Jr. | 81/60 |
| 4,420,995 | 12/1983 | Roberts | 81/601 |
| 4,480,511 | 11/1984 | Nickipuck | 81/177 G |
| 4,508,005 | 4/1985 | Herman et al. | 81/177.85 |
| 4,537,100 | 8/1985 | Palm | 403/325 |
| 4,571,113 | 2/1986 | Coren | 403/322 |
| 4,768,405 | 9/1988 | Nickipuck | 81/177.85 |
| 4,848,196 | 7/1989 | Roberts | 81/177.85 |
| 4,905,549 | 3/1990 | Nickipuck | 81/177.85 |
| 5,214,986 | 6/1993 | Roberts | 81/177.85 |
| 5,233,892 | 8/1993 | Roberts | 81/177.85 |

FOREIGN PATENT DOCUMENTS

| | | |
|---|---|---|
| 0066710 | 12/1982 | European Pat. Off. . |
| 847209 | 10/1939 | France . |
| 2121316 | 9/1972 | Germany . |

*Primary Examiner*—Willis Little

*Attorney, Agent, or Firm*—Willian Brinks Hofer Gilson & Lione

[57] ABSTRACT

A tool of the type having a drive stud for receiving and releasing a tool attachment includes an opening in the drive stud and a locking pin movably mounted in the opening. The opening defines upper and lower ends, and the lower end of the opening is located at a portion of the drive stud constructed for insertion into the tool attachment. An actuating member is movably positioned on the drive stud, and the actuating member includes a blade that defines a sliding surface oriented transversely to the locking member to fit within a slot in the locking member and engage a ledge surface of the locking member. Movement of the actuating member along the longitudinal axis of the drive stud in a selected direction causes the ledge surface to slide along the sliding surface to move the locking member from an engaging to a release position.

9 Claims, 1 Drawing Sheet

QUICK RELEASE MECHANISM FOR TOOLS SUCH AS SOCKET WRENCHES

BACKGROUND OF THE INVENTION

This invention relates to torque transmitting tools of the type having a drive stud shaped to receive and release a tool attachment, and in particular to an improved quick release mechanism for securing and releasing a tool attachment to and releasing it from the drive stud.

U.S. Pat. No. 4,848,196 discloses several quick release mechanisms for securing tool attachments such as sockets to torque transmitting tools such as wrenches. In these mechanisms the tool includes a drive stud which defines a diagonally oriented opening, and a locking pin is positioned within the opening so as to move in the opening. In its engaging position, the lower end of the locking pin engages a recess in the socket so as to lock the socket positively in place on the drive stud. When the operator moves the pin in the opening, the lower end of the pin is moved out of contact with the socket, and the socket is released from the drive stud.

In the mechanism shown in FIGS. 1 through 5 of U.S. Pat. No. 4,848,196, the locking pin is held in place by an extension spring which surrounds the shaft of the drive stud. In the version shown in FIGS. 6 and 7, the extension spring is covered by a protective sleeve 70 with flanges 74, 76.

U.S. Pat. No. 5,233,892 discloses another quick release mechanism in which a diagonally oriented locking pin includes an enlarged head which bears on a sliding surface of a collar. The sliding surface is oriented at an angle transverse to the orientation of the locking pin such that the collar can be manipulated to retract the pin.

SUMMARY OF THE INVENTION

It is an object of this invention to provide an improved quick release mechanism which is simple in construction; which requires only a few, easily manufactured parts; which is rugged and reliable in use; which automatically accommodates various sockets, including those with and without recesses designed to receive a detent; which substantially eliminates any precise alignment requirements; which is readily cleaned; which presents a minimum of snagging surfaces; and which is low in profile.

This invention represents an improvement in a tool of the type comprising a drive stud for receiving and releasing a tool attachment; wherein the drive stud has an opening therein; wherein a locking member is movably disposed in the opening; wherein the drive stud defines a longitudinal axis and the opening is oriented at a first non-zero skew angle with respect to the longitudinal axis; wherein the opening defines upper and lower ends, the lower end of the opening being located at a portion of the drive stud constructed for insertion into the tool attachment; and wherein the lower end of the locking member is constructed to engage the tool attachment when the locking member is positioned in an engaging position and to release the tool attachment from the drive stud when the locking member is moved to a release position.

According to the present invention, an actuating member is slidably positioned on the drive stud to move along the longitudinal axis. The locking member defines a slot, and a portion of the locking member adjacent the slot comprises a ledge surface. The actuating member defines a blade positioned to fit within the slot, and the blade comprises a sliding surface positioned to engage the ledge surface. The sliding surface is oriented at a second angle with respect to the longitudinal axis such that movement of the actuating member along the longitudinal axis in a selected direction causes the ledge surface to slide along the sliding surface, thereby moving the locking member in the opening from the engaging to the release positions.

The preferred embodiment described below is unusually simple, compact, rugged and inexpensive to manufacture.

DETAILED DESCRIPTION OF THE PRESENTLY PREFERRED EMBODIMENTS

Figure 1:
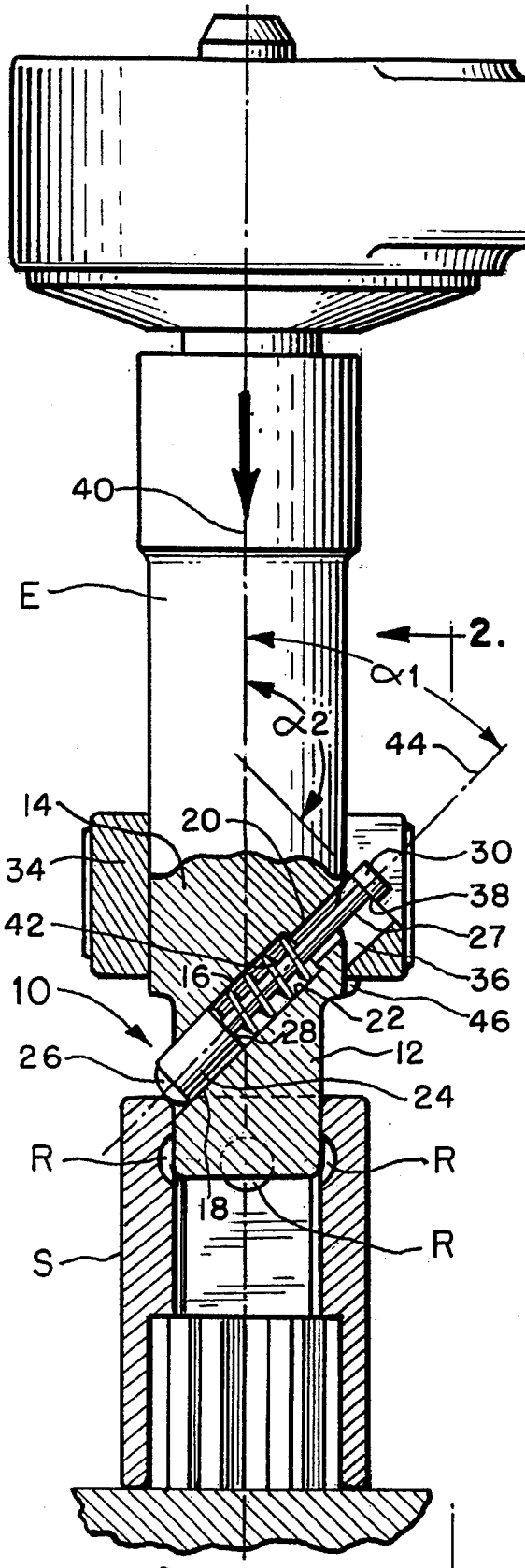
FIG. 1 is a side elevational view partially in cross section of a rachet socket wrench, an extension bar and a socket disposed for attachment to the lower end of the extension bar and showing the presently preferred embodiment of the quick release mechanism of this invention.
Figure 2:
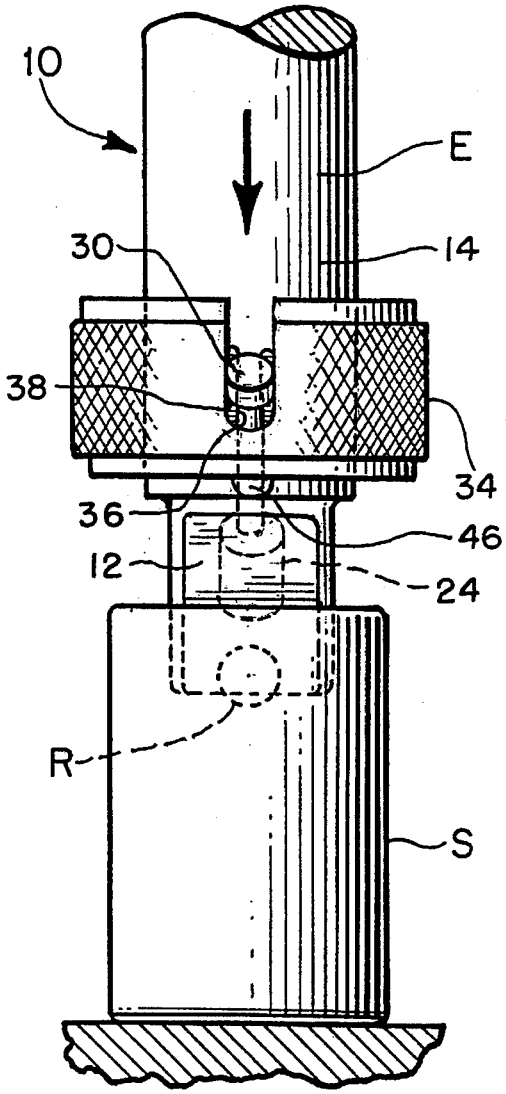
FIG. 2 is a side view of FIG. 1.
Figure 1:
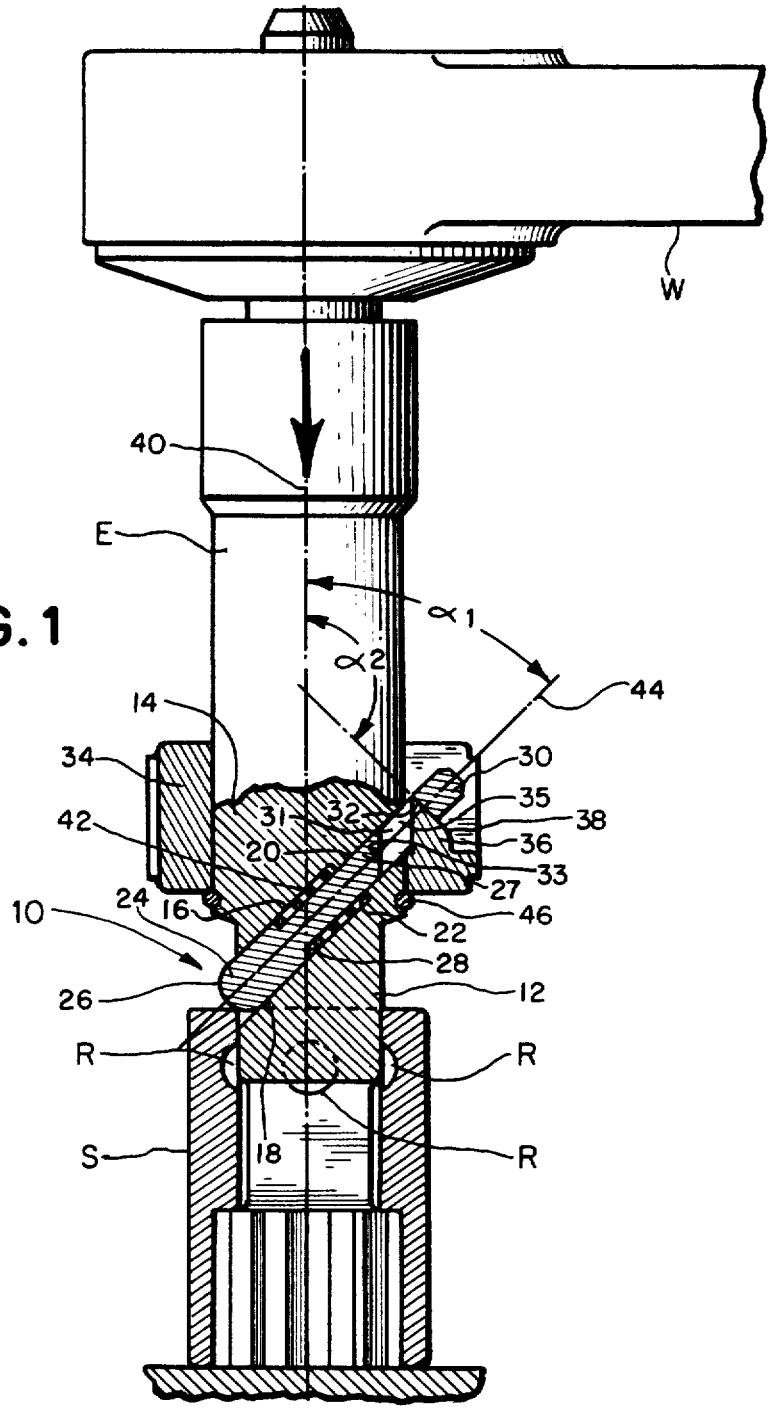

Turning now to the drawings, FIG. 1 shows a side elevational view of a tool which in this preferred embodiment is an extension bar E. As shown in FIG. 1, extension bar E is designed to be mounted on a wrench W and to fit into and transmit torque to a socket S. The extension bar E terminates at its lower end in a drive stud 10 having a lower portion 12 and an upper portion 14. The lower portion 12 is constructed for insertion into the socket S, and defines an out-of-round cross section. Typically, the lower portion 12 has a square, hexagonal or other non-circular shape in horizontal cross section. The upper portion 14 will often define a circular cross section, though this is not required.

As shown in FIG. 1, the drive stud 10 is configured to define a diagonally positioned opening 16 having a lower end 18 and a upper end 20. The lower end 18 is positioned in the lower portion 12 of the drive stud 10, and the upper end 20 is positioned in the upper portion 14 of the drive stud 10. The opening 16 has a smaller diameter adjacent the upper end 20 than the lower end 18, and the opening 16 defines a transverse step 22 between the larger and smaller diameter portions of the opening 16.

The foregoing features of the wrench W, extension bar E and socket S are substantially as described in connection with FIGS. 20 –25 of U.S. Pat. No. 4,848,196. It may be preferable in some embodiments to provide the opening 16 with a constant diameter, and to define the step 22 in some other manner, as for example with a plug of the type shown in FIG. 20 of U.S. Pat. No. 4,848,196.

As shown in FIG. 1, a locking member such as a pin 24 is slidably positioned in the opening 16. This pin 24 defines a lower end 26 shaped to engage the socket S. The lower end 26 of the pin 24 may be conventionally rounded, or it may alternately be provided with a step as shown in U.S. Pat. No. 4,848,196. Though illustrated as a pin 24, the locking member may take various shapes, including irregular and elongated shapes. If desired, the pin 24 may be provided with an out of round cross section and the opening 16 may define a complementary shape such that a preferred rotational position of the pin 24 in the opening 16 is automatically obtained. The pin 24 defines a reduced diameter neck 27 that terminates at one end at a step 28 and at the other at a head 30. The pin 24 defines a slot 31 near the head 30. The slot 31 extends completely through the pin 24 and is bounded at its upper portion by a ledge surface 32. The lower extent of the slot 31 is defined by a lower surface 33, and two side surfaces 35 (only one shown in FIG. 1) extend between the ledge surface 32 and the lower surface 33. In effect, the slot 31 forms a window or a passageway extending through the pin 24. The ledge surface 32 may be flat, convex, concave or spherical. Similarly, other shapes for the ledge surface 32 are possible so as to allow the ledge surface 32 and sliding surface 38 to cooperate with each other so as to move relative to each other without binding. Furthermore, surface 32 may be discontinuous or have a plurality of surfaces.

Also as shown in FIG. 1, an actuation member such as a collar 34 is positioned around the upper portion 14 of the drive stud 10. This collar 34 defines a blade 36 sized to be received within the slot 31 in the pin 24. The blade 36 is a freestanding structure connected to the remainder of the collar 34 only at its base. The upper most portion of the blade 36 forms a sliding surface 38 positioned to engage the ledge surface 32 in sliding contact.

As best shown in FIG. 1, the drive stud 10 defines a longitudinal axis 40, and the collar 34 is guided to move along the longitudinal axis 40. The opening 16 defines an opening axis 44 which is oriented at a first non-zero acute angle $\alpha 1$ with respect to the longitudinal axis 40. The sliding surface 38 is oriented at a second non-zero skew angle $\alpha 2$ with respect to the longitudinal axis. The angles $\alpha 1$ and $\alpha 2$ preferably differ by 90°. With this arrangement, the sliding surface 38 is oriented parallel to the ledge surface 32 and transverse to the pin 24. In other embodiments, the sliding surface 38 may have other shapes, such as a discontinuous surface or a plurality of surfaces, to allow relative movement between sliding surface 38 and ledge surface 32 without binding. Thus, it is contemplated to employ all combinations of shapes for ledge surface 32 and sliding surface 38 which allow them to cooperate with each other so as to move relative to each other without binding.

A spring such as a coil spring 42 biases the pin 24 to the engaging position shown in FIG. 1. As shown, the spring 42 is an extension spring which bears between the step 22 and the step 28 in the locking pin 24, with the neck 27 passing through the spring 42. In alternate embodiments the spring may be implemented in other forms, as for example by means of a leaf spring. Furthermore, if a coil spring is used, it may be employed as either a compression or an extension spring with suitable alterations to the design of FIG. 1, and the spring may be eliminated in some embodiments.

The pin 24, the collar 34 and the spring 42 can be assembled in a straightforward manner on the drive stud 10. First the spring 42 is placed around the neck 27 of the pin 24, and this assembly is then placed in the opening 16 via the lower end 18. The spring 42 is then compressed between the step 28 on the pin 24 and the step 22 in the opening 16 to cause the head 30 to protrude out of the opening 16. Then the collar 34 is moved past the lower portion 12 onto the upper portion 14 of the drive stud 10, with the blade 36 passing into the slot 31, and with the ledge surface 32 sliding on the sliding surface 38. Once the collar 34 is properly seated a retaining ring 46 which may be a spring ring is installed in a previously formed recess on the drive stud 10 so as to capture the collar 34 in place. This completes assembly. It is contemplated that other means are available for capturing the collar 34 in place. For example, an upset can be used as described in U.S. Pat. No. 5,233,892. Furthermore, an upset if used may be formed on the collar 34 to capture the collar 34 in place, and other means such as staking may be used.

The pin 24 simultaneously serves a number of separate functions. First, it releasably secures the socket S to the drive stud 10 as described below. Second, the pin 24 engages the blade 36 and thereby limits movement of the collar 34 away from the lower portion 12 of the drive stud 10. The pin 24 cooperates with the retaining ring 46 described above to capture the collar 34 positively in place, and the blade 36 prevents any undesired rotation of the collar 34.

Though the actuating member is shown as a collar 34 that slides along the longitudinal axis 40, an alternate embodiment of the actuating member may be formed as a slide that does not encircle the drive stud 10.

The operation of the quick release mechanism described above as seen by user is identical to the operation of the quick release mechanism shown in FIGS. 1–6 of U.S. Pat. No. 5,233,892. The entirety of U.S. Pat. No. 5,233,892 is hereby incorporated by reference, in particular for its description of the use of a quick release mechanism by an operator.

This invention can be adapted for use with the widest range of torque transmitting tools, including hand tools, power tools and impact tools. Simply by way of illustration, this invention can be used with socket wrenches, including those having ratchets, T-bar wrenches, and speeder wrenches, all as described and shown in U.S. Pat. No. 4,848,196. Furthermore, this invention is not limited to sockets of the type shown, but can be used with a wide range of tool attachments, including sockets or tool attachments with varying sized recesses R and even on sockets without a recess of any type.

Of course, the quick release mechanism of this invention can be used in any physical orientation, and the terms upper, lower and the like have been used with reference to the orientation shown in the drawings. Furthermore, the terms "engaging position" and "release position" are each intended to encompass multiple positions within a selected range. For example, in the embodiment of FIG. 1 the exact position of the engaging position will vary with the depth of the recess R in the socket S, and the exact position of the release position may vary with a variety of factors, including the extent to which the actuating member is moved.

As suggested above, the present invention can be implemented in many ways, and this invention is not limited to the specific embodiment shown in the drawings. However, in order to define the presently preferred embodiment of this invention the following presently preferred details of construction are provided. These details are of course in no way intended to limit the scope of this invention.

By way of example, the pin 24 may be formed of a material such as a steel of moderate to mild temper, and the collar 34 may be formed of any suitable material such as brass, steel, other metals, or suitable plastics. The angle $\alpha 1$ may range from about 30° to about 45° and the angle $\alpha 2$ may range from about 150° to about 135°.

From the foregoing description it should be apparent that the objects set out initially above have been achieved. In particular, the mechanism shown in the drawings is low profile with respect to the circumference of the extension bar E. The disclosed mechanism is simple to manufacture and assemble, and it requires relatively few parts. It is rugged in operation, and it automatically engages a socket as described above. Because of its design, the mechanism will accommodate various types of sockets, including sockets with various types of recesses or no recess at all. In the illustrated embodiment, the collar 34 may be gripped at any point on its circumference, and does not require the operator to use a preferred angular orientation of the tool. Furthermore, the outer circumference of collar 34 may be knurled or ridged to allow manipulation of collar 34 with a single finger.

In that the ledge surface 32 is defined by an internal portion of the pin 24, the upper portion of the pin 24 near the head 30 can be of relatively large diameter as compared with the pin of U.S. Pat. No. 5,233,892. This can simplify fabrication of the pin 24, and it eliminates the need for three different cross-sectional diameters for the pin. The result is a pin 24 that is particularly robust.

In some alternate embodiments, the locking member may be configured to require a positive action on the part of the operator to retract the locking member as the drive stud is moved into the socket. Certain of these embodiments may require recesses in the sockets as described above to provide all of the functional advantages described.

In the preferred embodiment described above the difference between the first and second angles $\alpha 1$ and $\alpha 2$ is approximately 90°. This minimizes skew forces applied to the pin 24 and minimizes any tendency of pin 24 to bind in the opening 16. However, if friction between the pin 24 and the walls of the opening 16 is sufficiently low, the sliding surface 38 may be positioned at a skew angle with respect to the pin 24, rather than the transverse angle illustrated.

It is intended that the foregoing detailed description be regarded as illustrative rather than limiting, and that it be understood that it is the following claims, including all equivalents, which are intended to define the scope of this invention.

I claim:

1. In a tool comprising a drive stud for receiving and releasing a tool attachment; said drive stud having an opening therein and a locking member movably disposed in said opening; said drive stud defining a longitudinal axis and the opening oriented at a first non-zero angle with respect to the longitudinal axis; said opening defining upper and lower ends, the lower end of said opening being located at a portion of said drive stud constructed for insertion into said tool attachment; the lower end of said locking member being constructed to engage said tool attachment when said locking member is positioned in an engaging position and to release said tool attachment from said drive stud when said locking member is moved to a release position; the improvement comprising:

an actuating member slidably positioned on said drive stud to move along said longitudinal axis;

said locking member defining a slot, a portion of said locking member adjacent said slot comprising a ledge surface;

said actuating member defining a blade positioned to fit within the slot, said blade comprising a sliding surface positioned to engage the ledge surface, said sliding surface oriented at a second angle with respect to the longitudinal axis such that movement of the actuating member along the longitudinal axis in a selected direction causes the ledge surface to slide along the sliding surface, thereby moving the locking member in the opening from the engaging to the release positions.

2. The invention of claim 1 wherein the second angle is a non-zero skew angle; wherein the upper end of said opening is externally open above that portion of said drive stud constructed for insertion into said tool attachment; and wherein said actuating member extends above that portion of said drive stud constructed for insertion into said tool attachment, for receiving manually applied forces from an operator to move said locking member repetitively between said release and engaging positions.

3. The invention of claim 1 or 2 further comprising a spring operative to bias the locking member to the engaging position.

4. The invention of claim 3 wherein said spring comprises a coil spring disposed in said opening, and wherein the locking member passes through said coil spring.

5. The invention of claim 1 or 2 wherein said actuating element comprises a collar positioned around the drive stud.

6. The invention of claim 1 or 2 wherein the sliding surface is oriented substantially transverse to the locking member.

7. The invention of claim 2 wherein the difference between the first non-zero angle and the second non-zero skew angle is about 90°.

8. The invention of claim 1 wherein the slot forms a four-sided window extending through the locking member.

9. The invention of claim 8 wherein the blade comprises a base, and wherein the blade is a free-standing structure connected to the actuating member only at the base.

* * * * *

UNITED STATES PATENT AND TRADEMARK OFFICE

CERTIFICATE OF CORRECTION

PATENT NO. : 5,503,048

DATED : April 2, 1996

INVENTOR(S) : C. Robert Moon

It is certified that error appears in the above-identified patent and that said Letters Patent is hereby corrected as shown below:

Drawings: Figure 1 should be deleted to appear as per attached.

The Title page, should be deleted and substitute therefor the attached title page.

Signed and Sealed this

Fourteenth Day of April, 1998

Bruce Lehman

*Attest:*

BRUCE LEHMAN

*Attesting Officer*

*Commissioner of Patents and Trademarks*

United States Patent [19]

Moon

[11] Patent Number: 5,503,048

[45] Date of Patent: Apr. 2, 1996

[54] QUICK RELEASE MECHANISM FOR TOOLS SUCH AS SOCKET WRENCHES

[75] Inventor: C. Robert Moon, Joliet, Ill.

[73] Assignee: Link Industries, Inc., Chicago, Ill.

[21] Appl. No.: 309,085

[22] Filed: Sep. 20, 1994

[51] Int. Cl.[6] ..... B25B 13/00

[52] U.S. Cl. ..... 81/177.85; 81/177.2; 403/20

[58] Field of Search ..... 81/177.85, 177.2, 81/177.1; 403/20, 322, 325, 328, 379; 285/385

[56] References Cited

U.S. PATENT DOCUMENTS

| | | | |
|---|---|---|---|
| 1,569,117 | 1/1926 | Carpenter . | |
| 1,660,989 | 2/1928 | Carpenter . | |
| 1,775,402 | 9/1930 | Mandl . | |
| 1,864,466 | 6/1932 | Peterson . | |
| 2,072,463 | 3/1937 | Mims | 81/125 |
| 2,108,866 | 2/1938 | Mandl | 287/119 |
| 2,290,215 | 7/1942 | Stenberg | 287/53 |
| 2,721,090 | 10/1955 | Kaman | 287/119 |
| 2,736,562 | 2/1956 | Blackburn | 279/76 |
| 3,011,794 | 12/1961 | Vaughn | 279/76 |
| 3,018,866 | 1/1962 | Elliott et al. | 192/150 |
| 3,069,945 | 12/1962 | Shandel | 81/53 |
| 3,094,344 | 6/1963 | Varga | 287/52.08 |
| 3,156,479 | 11/1964 | Drazick | 279/76 |
| 3,167,338 | 1/1965 | Troike | 287/119 |
| 3,208,318 | 9/1965 | Roberts | 81/177 |
| 3,515,399 | 6/1968 | Wordsworth | 279/93 |
| 3,613,221 | 3/1969 | Pronk | 29/526 |
| 3,777,596 | 12/1973 | Smyers, Jr. et al. | 81/177 G |
| 3,822,074 | 7/1974 | Weicker | 285/305 |
| 3,890,051 | 6/1975 | Biek | 403/20 |
| 4,367,663 | 1/1983 | Merics | 81/177 A |
| 4,399,722 | 8/1983 | Sardo, Jr. | 81/60 |
| 4,420,995 | 12/1983 | Roberts | 81/601 |
| 4,480,511 | 11/1984 | Nickipuck | 81/177 G |
| 4,508,005 | 4/1985 | Herman et al. | 81/177.85 |
| 4,537,100 | 8/1985 | Palm | 403/325 |
| 4,571,113 | 2/1986 | Coren | 403/322 |
| 4,768,405 | 9/1988 | Nickipuck | 81/177.85 |
| 4,848,196 | 7/1989 | Roberts | 81/177.85 |
| 4,905,549 | 3/1990 | Nickipuck | 81/177.85 |
| 5,214,986 | 6/1993 | Roberts | 81/177.85 |
| 5,233,892 | 8/1993 | Roberts | 81/177.85 |

FOREIGN PATENT DOCUMENTS

| | | |
|---|---|---|
| 0066710 | 12/1982 | European Pat. Off. . |
| 847209 | 10/1939 | France . |
| 2121316 | 9/1972 | Germany . |

*Primary Examiner*—Willis Little

*Attorney, Agent, or Firm*—Willian Brinks Hofer Gilson & Lione

[57] ABSTRACT

A tool of the type having a drive stud for receiving and releasing a tool attachment includes an opening in the drive stud and a locking pin movably mounted in the opening. The opening defines upper and lower ends, and the lower end of the opening is located at a portion of the drive stud constructed for insertion into the tool attachment. An actuating member is movably positioned on the drive stud, and the actuating member includes a blade that defines a sliding surface oriented transversely to the locking member to fit within a slot in the locking member and engage a ledge surface of the locking member. Movement of the actuating member along the longitudinal axis of the drive stud in a selected direction causes the ledge surface to slide along the sliding surface to move the locking member from an engaging to a release position.

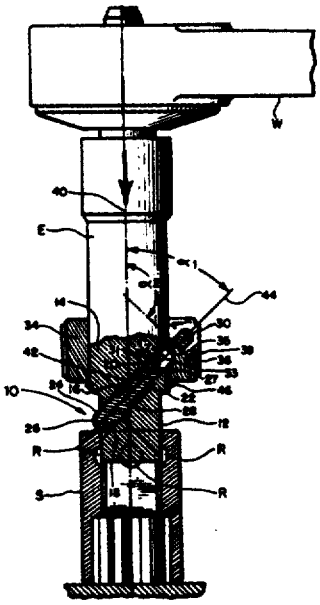

9 Claims, 1 Drawing Sheet